United States Patent [19]

Daglish et al.

[11] Patent Number: 4,687,587

[45] Date of Patent: Aug. 18, 1987

[54] METAL FORMING LUBRICANT

[75] Inventors: Alan R. Daglish, Dunstable; Mark H. Foster, Banbury; William F. Marwick, Byfield, all of United Kingdom

[73] Assignee: Alcan International Limited, Montreal, Canada

[21] Appl. No.: 821,499

[22] Filed: Jan. 22, 1986

[30] Foreign Application Priority Data

Jan. 29, 1985 [GB] United Kingdom ..... 8502148

[51] Int. Cl.[4] ..... C10M 129/68

[52] U.S. Cl. ..... 252/11; 252/56 R; 252/51.5 A; 585/9; 585/10

[58] Field of Search ..... 252/11, 58, 56 R, 51.5 A; 585/9, 10

[56] References Cited

U.S. PATENT DOCUMENTS

| | | | |
|---|---|---|---|
| 2,621,159 | 12/1952 | Perry et al. | 252/58 |
| 3,069,280 | 12/1962 | Spiegler | 252/58 |
| 3,102,862 | 9/1963 | Green | 252/58 |
| 4,029,870 | 6/1977 | Brown et al. | 252/58 |
| 4,560,488 | 12/1985 | Vinci | 252/58 |

*Primary Examiner*—Jacqueline V. Howard

*Attorney, Agent, or Firm*—Cooper, Dunham, Griffin & Moran

[57] ABSTRACT

A lubricant for metal forming comprises a dispersion of particles of a waxy material in a solution or dispersion in a volatile liquid medium of a monomeric organic carrier which is a solid or a viscous liquid at ambient temperature. The particles may be 5–25 microns, the volatile liquid may be xylene, the carrier may be an ester with a MW below 320 and the weight ratio of particles to carrier may be 1:1 to 6:1. The waxy particles provide good lubricating performance without coalescing under load. The lubricant is compatible with adhesive and is easily removed from a workpiece.

15 Claims, No Drawings

METAL FORMING LUBRICANT

A metal-forming lubricant needs to comply with many requirements because the many and varied deformation conditions in metal-forming operations make different demands on the lubricant. Specification is further complicated by the fact that lubricating performance is not the only factor involved, other requirements including, for example, protection of the metal surface from abrasion or other chance damage, ease of application, viscosity, ease of removal, cost, and health and safety factors. In one particular application, the forming of sheet aluminium into components to form adhesively bonded structures, a further requirement may be compatibility with subsequently applied coating materials. Most lubricants are homogeneous blends formulated for a specific application where one or more properties are favoured above the others but which is nevertheless a compromise between conflicting requirements.

Heterogeneous lubricants are also well known, for example dispersions of lubricant substances in water or other volatile medium. But such lubricants are intended, on application to a metal workpiece and evaporation of the volatile medium, to leave a continuous homogeneous lubricant film on the metal workpiece.

To achieve a balance of properties metal-forming lubricants currently employ a range of oils, waxes, soaps and occasionally polymeric materials, each of which has advantages for specific applications. In the current state of technology none of these can offer optimum properties for all the varied requirements noted above. It would be desirable to be able to formulate a lubricant to have a specific combination of desirable properties to meet these requirements.

The present invention is based on the idea that the lubricant can be provided, not as a continuous film, but as discrete solid particles which protect the metal surface during working but without coalescing to form a continuous film.

In one aspect, the invention provides a metal-forming method comprising applying a lubricant to the surface of a metal workpiece and thereafter deforming the workpiece, characterized in that the lubricant comprises discrete particles of a waxy material having a softening point above the metal-forming temperature in a solid or viscous liquid monomeric organic carrier.

In another aspect, the invention provides a lubricant for metal-forming comprising a dispersion of particles of a waxy material in a solution or dispersion in a volatile liquid medium of a monomeric organic carrier which is a solid or viscous liquid at ambient temperature.

Two advantages of particulate lubricants over continuous films may be mentioned. After deformation of a workpiece, lubricant may need to be removed from the metal surface; particles are often easier to remove than a continuous film. Again after deformation of a workpiece, some coating material such as lacquer, paint or adhesive may need to be applied to the metal surface in the presence of the lubricant; such application is more satisfactory if the coating material can displace or penetrate the carrier medium between lubricant particles.

One process in which the present invention will be useful is that for forming sheet aluminium into components to form adhesively bonded structures e.g. for motor vehicles. That process includes the following steps:

A. Aluminium in coil form is continuously cleaned and surface treated to ensure good bonding, at a later stage, to the adhesive.

B. Then a lubricant is applied to the surface. One purpose of this is to protect the surface from corrosion or hydration or from abrasion or mechanical damage, for the metal may be stored at this stage, either in coil form or as pre-cut blanks, for weeks or months.

C. The blanks are formed into the desired shaped components. Once this has been done the lubricant is no longer required. But it would need an additional operation on the production line to remove it at this stage, which would be expensive.

D. Adhesive is applied where required and the components are assembled together in the shape of the desired structure. This may be spot-welded to hold the components in position. The adhesive may be cured at this stage by heating the structure in an oven.

E. If the structure is to be painted, it is first cleaned by a treatment which removes the lubricant. The cleaning operation is preferably carried out at a temperature above the softening point of the carrier medium. Then one or more coats of paint is applied. Finally the coats of paint are cured by again heating the structure in an oven. It may be possible to use this heating step to cure the adhesive also and so to dispense with the curing step of D.

For use in this process, a lubricant needs to fulfil several requirements. To protect the metal surface on storage (B) it needs to form a continuous film. And the film should preferably be solid at the storage temperature, since a liquid film would tend to flow and to pick up dust and grit. Metal-forming (C) involves stretching and deforming the components and requires particular load-bearing lubricant properties. When the adhesive is applied (D) it needs to be able to gain access of the pretreated metal surface, for which purpose the continuous phase of the lubricant film needs to be compatible with the adhesive, is readily dissolve in, be displaced by, or react with the adhesive without destroying the bonding power of the latter, while the particulate waxy material is insoluble. Finally, the lubricant needs to be readily removed (E), preferably by an aqueous cleaner. The lubricants with which this invention is concerned are well adapted to fulfil these requirements. The waxy material of the discrete particles can be chosen to have the load-bearing properties required for metal-forming. The carrier is formulated to provide a preferably solid film which protects the metal surface, binds the particles to the surface, dissolves in or reacts with the adhesive, and is readily removed by cleaner. By virtue of their discontinuous nature, the particles are also readily removed by cleaner.

Notwithstanding this important application, the lubricants with which this invention is concerned are useful as general purpose press lubricants for forming different metals, particularly aluminium (including Alrich alloys).

The waxy material of which the particles are made may be of animal, vegetable, mineral or synthetic origin. It may comprise esters of high molecular weight monohydric alcohols with fatty acids; paraffin waxes including microcrystalline waxes; low m.w. polyethylene; and amide waxes. It is preferred to use a hard high-melting wax, in order that the discrete particles be not smeared of flattened to the extent of coalescing into a continuous film during metal-forming.

The size of the particles does not appear to be very critical as regards lubricant performance. The maximum size is determined by two main factors, the need to provide particles sufficiently closely spaced to avoid the risk of damage to the metal substrate in the intervening gap, and the need to hold the particles adjacent the metal surface and to avoid the risk of accidental removal. These factors indicate an upper limit on particle diameter of 100 microns, more preferably 40 microns. At the other end of the scale, particles below about 1 micron may so increase the viscosity of the lubricant as to make application difficult. A suitable particle size range is 5–25 microns. Particulate waxy materials are available commercially, as they are used in the printing ink industry.

The particulate waxy material should be used at a level sufficient to perform the desired lubricating function. For many applications there is no critical upper limit. But where removal is necessary, or more especially where a coating material has to be applied over the lubricant, no more lubricant should be used than is necessary.

These wax particles do not by themselves adhere to metal. According to this invention, they are held in position by a film of a monomeric organic carrier that is a viscous liquid, or preferably a solid, at ambient temperature. The carrier preferably has a molecular weight not more than 320, more preferably not more than 250. In the particular case of adhesively bonded aluminium structures, the carrier preferably has carboxyl or hydroxyl groups, by means of which it can react with and be absorbed into a subsequently applied adhesive. Suitable materials include fatty acids, fatty alcohols, and long-chain esters. Although many of these materials, for example lauric acid, are known as load-bearing additives for metal-rolling lubricants, their lubricating properties are generally not by themselves adequate for the metal-forming applications envisaged. But their lubricating properties are not of paramount importance.

Compounds of metals are preferably not present on the ground that they generally impair adhesive performance. For example, metal soaps are widely used as lubricants but are not compatible with adhesives. Again, inorganic particulate matter is sometimes included in lubricant compositions but can adversely affect the performance of adhesives which are formulated to contain precise contents of inorganic matter. Furthermore, many conventional lubricants are used in the form of aqueous emulsions which contain surface active agents. These can cause problems on storage of lubricated sheet, or in respect of long term adhesion performance, and are preferably not used in this invention. Similarly, polymeric organic carriers are often not adhesive-compatible in the same way as the monomeric materials described above, and are also preferably not used in this invention.

At least enough carrier needs to be used to provide a film of sufficient thickness to securely hold the particles of waxy material and more may be used to provide additional surface protection and to inhibit coalescence of the waxy particles. Depending on the particle size, a carrier film thickness of 2–15 microns may be satisfactory. The weight ratio of particulate waxy material to carrier is preferably kept as high as possible. This weight ratio is generally in the range 10:1 to 1:10, preferably 1:1 to 6:1, particularly 2:1 to 5:1. In the particular case of bonded aluminium structures for motor vehicles noted above, where adhesive is applied over the lubricant, the rate of application is preferably in the range of 2–10 grams of lubricant per square meter of metal surface.

To simplify application, the carrier may be dissolved or dispersed in a volatile liquid medium, preferably a volatile organic solvent such as xylene, which however does not dissolve the waxy particles. The lubricant may be formulated to a suitable viscosity and applied complete to the metal surface, preferably as a uniform film by a technique such as roll coating. Alternatively a solution or dispersion of the carrier in the volatile liquid medium may be applied to the metal surface and the particulate waxy material sprayed on to the resulting film. In either case there results, after evaporation of the volatile liquid at a temperature below the melting point of the waxy material, a viscous or preferably solid film of the carrier firmly holding the discrete particles of waxy material in place.

EXPERIMENTAL

Adhesive/lubricant compatibility was measured by the following test. Panels of aluminium 5251 alloy which had been degreased and surface treated were bar-coated with lubricants to give an even and accurate film. Lubricants were dried at about 80° C. and coat-weights determined by weight difference. The panels were then cut to give 100 mm×20 mm strips and holes punched in the strip to give coupons of the standard size for lap-joint jigs. A proprietary adhesive sold under the Trade Mark ESP 105 was then applied manually to cleaned and surface treated, but unlubricated, coupons, and lap-joints made by firmly mating one of these to each lubricated coupon. The lap-joints were cured for 30 minutes at 180° C. and tested for shear strength.

Formability was measured by the following test. Lubricant was bar-coated onto degreased aluminium 5251 alloy discs of 10 cm diameter. Formability (E) was measured as the strain on a scribed cross-hatch in the middle of a dome pressed into the disc.

EXAMPLE 1

Lubricants were prepared to the following formulation:

Amide wax 'C' 20 parts by weight
Xylene: 60 parts by weight
Carrier: 20 parts by weight Amide wax 'C' is a hard wax of very high drop point sold by Hoechst A. G. It was used in a particle size of 20–40 microns. The lubricants were tested for adhesive compatibility and formability and the results are set out in Table 1. Lauric acid is preferred to dioctyl adipate because the latter is liquid at ambient temperature.

EXAMPLE 2

Lubricants were based on combinations of Amide wax 'C' with dioctyl adipate in various proportions, xylene being used as a thinner as required. The lubricants were tested for adhesive compatibility and formability and the results are set out in Table 2. The lubricant containing wax and dioctyl adipate in a weight ratio of 4:1 performed best.

EXAMPLE 3

Lubricants were prepared to the following formulation:

Waxy material: 32 parts by weight

Ethylene glycol monoethyl ether: 60 parts by weight
Lauric acid (dodecanoic acid): 8 parts by weight The lauric acid was dissolved in the volatile solvent and the particles of waxy material stirred in. Various different waxes were used:

Hydrocarbon A 616, a Fischer-Tropsch wax sold by Huels A. G.

Polyethylene wax PE 130 sold by Hoechst A. G., a very hard wax having a high drop point.

Amide wax 'C' sold by Hoechst A. G., a hard wax having a very high drop point.

Ethylene bis stearamide (Ebs) sold by Pennine Chemical Co., a hard waax having a very high drop point.

The lubricants were tested for adhesive compatibility and formability and the results are set out in Table 3.

TABLE 1

Amide Wax C in Various Carriers

| Carrier | Coatweight ($g/m^2$) | Average bond strength (kN) | E mean |
|---|---|---|---|
| Lauryl alcohol | 7.0 | 3.40 | 0.068 |
| Tetradecanol | 7.4 | 3.42 | 0.068 |
| Decanoic acid | 7.3 | 3.48 | 0.073 |
| Lauric acid | 7.6 | 3.44 | 0.074 |
| Decane-1, 10-diol | 8.0 | 3.54 | 0.061 |
| Glyceryl mono oleate | 7.8 | 3.10 | 0.067 |
| Dioctyl adipate | 6.5 | 3.43 | 0.073 |
| No lubricant | | 3.60 | — |

TABLE 2

Amide Wax 'C' Wax and Dioctyl Adipate

| Ratio wax:doa | Total coatweight ($g/m^2$) | Average bond strength (kN) | E mean |
|---|---|---|---|
| — | no lubricant | 3.60 | — |
| 1:4 | 8.1 | 3.40 | 0.070 |
| 1:1 | 6.5 | 3.43 | 0.073 |
| 4:1 | 8.6 | 3.56 | 0.073 |

TABLE 3

Effect of Particle Size of Wax

| Wax | Coatweight ($g/m^2$) | Particle size (microns) | E mean | Average bond strength (kN) |
|---|---|---|---|---|
| Hydrocarbon A616 | 10.0 | 40–60 | 0.069 | 3.18 |
| PE130 | 7.9 | 60 | 0.070 | 3.18 |
| PE130 | 10.0 | 10 | 0.074 | 3.12 |
| Amide C | 8.3 | 20–40 | 0.068 | 3.39 |
| Amide C | 5.9 | 10 | 0.071 | 3.46 |
| Ebs | 7.1 | 20–40 | 0.083 | 3.42 |
| | 4.9* | 20–40* | 0.080* | 3.85* |

*Repeat measurements.

We claim:

1. A metal-forming method comprising applying a lubricant to the surface of a metal workpiece and thereafter deforming the workpiece, characterized in that the lubricant comprises discrete particles of a waxy material having a softening point above the metal-forming temperature in a solid or viscous liquid monomeric organic carrier, the discrete particles having diameters in the range of 1 to 100 microns and the weight ratio of discrete particles to monomeric carrier being from 1:10 to 10:1, and the waxy material being selected from the group consisting of esters of high molecular weight monohydric alcohols with fatty acids, paraffin waxes including microcrystalline waxes, low molecular weight polyethylene, and amide waxes.

2. A lubricant for metal-forming comprising a dispersion of particles of a waxy material in a solution or dispersion in a volatile liquid medium of a monomeric organic carrier which is a solid or viscous liquid at ambient temperature, the discrete particles having diameters in the range of 1 to 100 microns and the weight ratio of discrete particles to monomeric carrier being from 1:10 to 10:1, and the waxy material being selected from the group consisting of esters of high molecular weight monohydric alcohols with fatty acids, paraffin waxes including microcrystalline waxes, low molecular weight polyethylene, and amide waxes.

3. A method of forming a structure of shaped aluminium components adhesively bonded together, by the steps of applying lubricant to the surface of aluminium coil, cutting and shaping the components from the lubricated coil, applying adhesive to the components in the presence of the lubricant, assembling the components in the shape of the desired structure, and curing the adhesive, characterized in that the lubricant comprises discrete particles of a waxy material having a softening point above the metal forming temperature in a solid or viscous liquid monomeric carrier, the discrete particles having diameters in the range of 1 to 100 microns and the weight ratio of discrete particles to monomeric carrier being from 1:10 to 10:1, and the waxy material being selected from the group consisting of esters of high molecular weight monohydric alcohols with fatty acids, paraffin waxes including microcrystalline waxes, low molecular weight polyethylene, and amide waxes.

4. A method as claimed in claim 1, wherein the particles of waxy material have a size range of 5 to 25 microns.

5. A method as claimed in claim 1, wherein the carrier has a molecular weight of not more than 320.

6. A method as claimed in claim 1, wherein the weight ratio of waxy particles to organic carrier is from 1:1 to 6:1.

7. A method as claimed in claim 1, wherein from 2 to 10 grams of lubricant are applied per square meter of metal surface.

8. A lubricant as claimed in claim 2, wherein the particles of waxy material have a size range of 5 to 25 microns.

9. A lubricant as claimed in claim 2, wherein the carrier has a molecular weight of not more than 320.

10. A lubricant as claimed in claim 2, wherein the weight ratio of waxy particles to organic carrier is from 1:1 to 6:1.

11. A method as claimed in claim 3, wherein the particles of waxy material have a size range of 5 to 25 microns.

12. A method as claimed in claim 3, wherein the carrier has a molecular weight of hot more than 320.

13. A method as claimed in claim 3, wherein the weight ratio of waxy particles to organic carrier is from 1:1 to 6:1.

14. A method as claimed in claim 3, wherein from 2 to 10 grams of lubricant are applied per square meter of metal surface.

15. A method as claimed in claim 3, wherein the lubricant carrier is compatible with the adhesive.

* * * * *